United States Patent [19]

Eibe et al.

[11] 4,038,857

[45] Aug. 2, 1977

[54] HYDRAULIC MILL STAND

[75] Inventors: Werner W. Eibe, McCandless Township, Allegheny County; Wilfred T. Farrell, Coraopolis, both of Pa.

[73] Assignee: Blaw-Knox Foundry & Mill Machinery, Inc., Pittsburgh, Pa.

[21] Appl. No.: 679,900

[22] Filed: Apr. 26, 1976

[51] Int. Cl.[2] ..... B21B 31/30

[52] U.S. Cl. ..... 72/244; 72/245

[58] Field of Search ..... 72/243, 244, 245, 248, 72/241, 237, 238

[56] References Cited

U.S. PATENT DOCUMENTS

| | | | |
|---|---|---|---|
| 2,853,905 | 9/1958 | Reisacher et al. | 72/244 X |
| 3,559,432 | 2/1971 | Rastelli | 72/19 |
| 3,691,809 | 9/1972 | Hlafcsak | 72/238 X |
| 3,779,062 | 12/1973 | Gegick | 72/244 |
| 3,805,573 | 4/1974 | Petros et al. | 72/244 |

*Primary Examiner*—Milton S. Mehr

*Attorney, Agent, or Firm*—Buell, Blenko & Ziesenheim

[57] ABSTRACT

A mill stand for a four-mill has a short-stroke hydraulic rolling pressure cylinder at the top of each housing. Variations in size of back-up rolls are taken up at the top of the mill by a series of graduated filler blocks positioned around a quadrant so as to form a circular staircase. The staircase is rotated about a vertical axis to bring the desired step between cylinder and roll chock. The lower roll set rests on straight staircases which are moved transversely of the housings on the conventional roll sled. Between the bottom of the sled and the bottom of each housing is a low-angle wedge positioned to raise the lower roll set an amount equal to one step of the staircase. The stand is aligned to the strip pass line by operation of the rolling pressure cylinders.

9 Claims, 11 Drawing Figures

Figure 1:
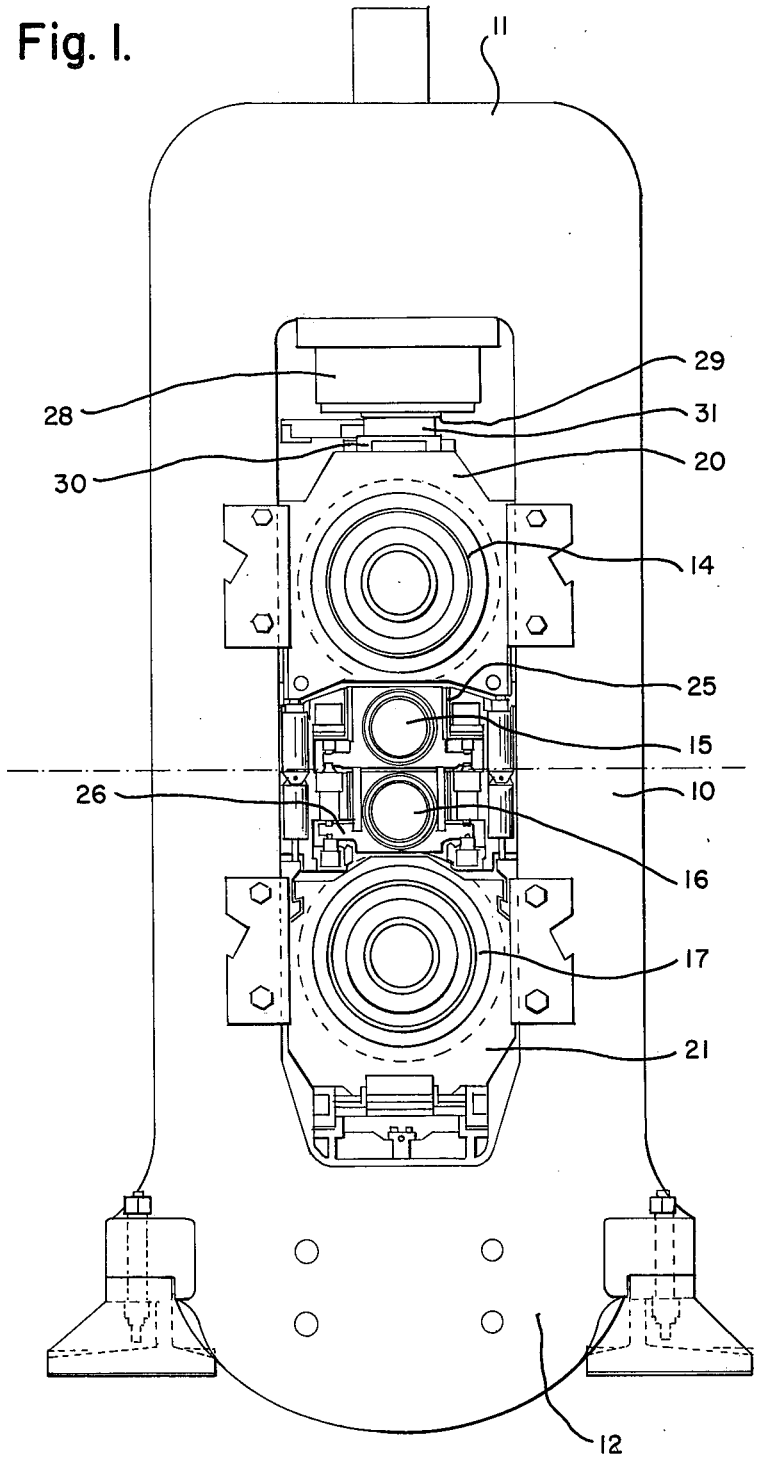

Fig. I.

20
14
14
20
23
25
52
15
15
52
50
50
54
80
54
55
55
80
10
51
51
10
60
60
16
16
61
81
83
83
24
57
57
56
61
56
26
81
82
82
62
17
17
62
21
21

Fig. 9.
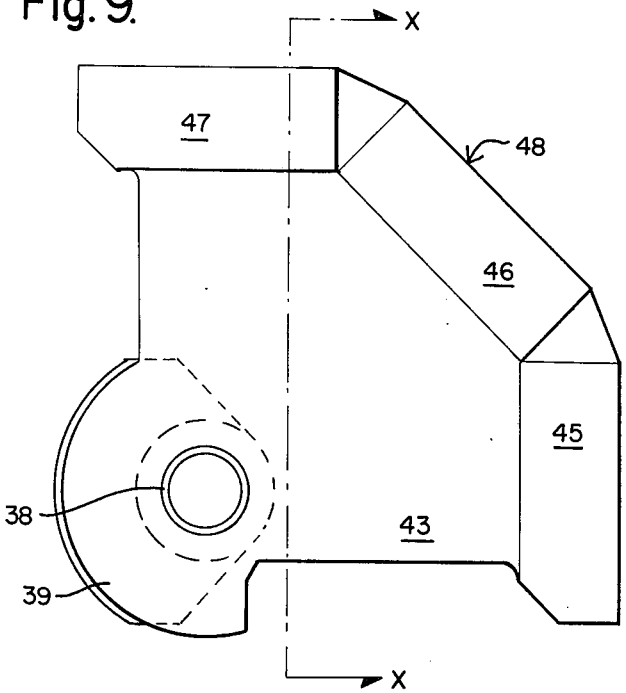
Fig. 10.
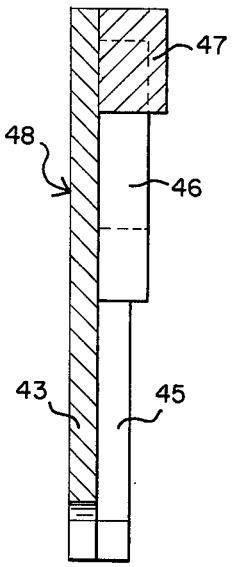
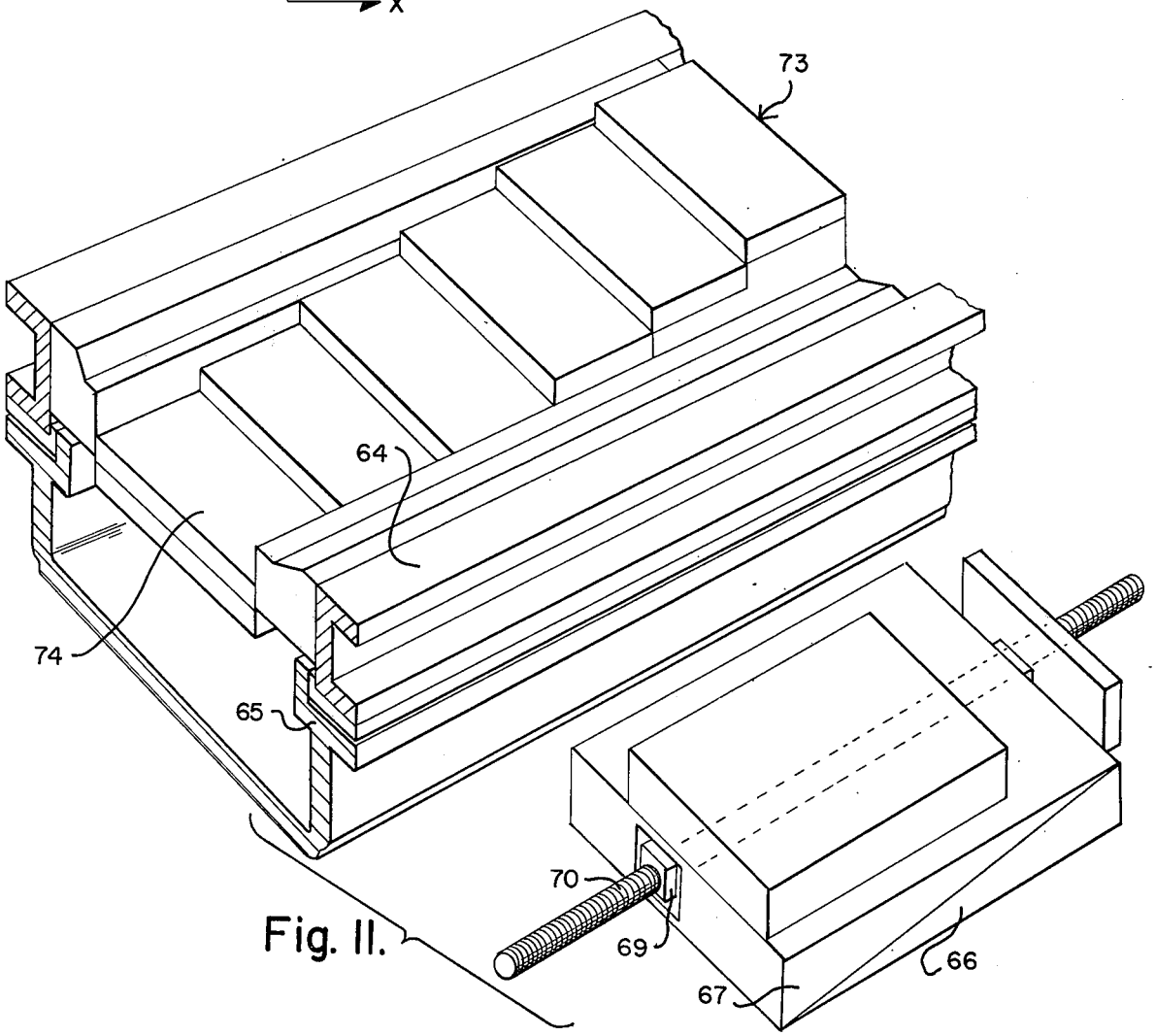
Fig. 11.

HYDRAULIC MILL STAND

This invention relates to four-high rolling mill stands for continuous production of strip metals. It is more particularly concerned with such stands having hydraulic means for applying pressure to the rolls and the process of their adjustment.

In four-high mill stands the relatively small diameter work rolls are driven and pressure is applied to them through larger diameter undriven backup rolls. Historically that pressure has been applied by screw devices bottomed on the upper back-up roll bearings and threaded through nuts in the cross heads of the mill housings. Those screws were motor driven and the pressure-applying apparatus was referred to as a screw-down. In addition to applying pressure to the mill the screw mechanisms were required to accommodate changes in back-up roll diameters resulting from wear and consequent remachining, which changes may amount to several inches. Thus screw-ups are also required to bring the lower rolls up to the pass line of the strip. These screw-downs and screw-ups were inherently slow in operation.

Rolls in such mill stands are changed by pulling them out laterally through the stand window. The substantial time required to retract mechanical screw-down mechanisms also slowed down roll changes. Furthermore, mechanical pressure apparatus on opposite ends of the rolls are difficult to balance. Because of those difficulties, and others, attempts have been made to replace mechanical screw-downs with hydraulic pressure systems, which can be made relatively fast acting and which are easier to balance.

Hydraulic cylinders, however, introduce problems of their own. If the cylinder itself moves it must be connected to the source of hydraulic fluid by a flexible hose. A cylinder at the bottom of the mill stand is difficult to shield from roll lubricants and metal scale. Under the pressures applied, particularly for cold rolling of steel, the mill stand housings, no matter how heavy they are made, elongate slightly, and the hydraulic fluid in the cylinder compresses slightly, to a somewhat different degree. In order to shorten the stroke of the hydraulic cylinder and thus stiffen the mill stand wedge systems between the cylinder and the roll chock have been suggested. Here again the proposed remedy imports its own problems. A fast-acting high-angle wedge is difficult to lock against mill vibration, while low-angle wedges require excessive amounts of room.

It is an object of our invention, therefore, to provide a four-high mill stand requiring a single pair only of hydraulic force-applying cylinders mounted at the upper ends of the housings. It is another object to provide such a mill stand requiring no flexible connections to the pressure-producing cylinders. It is still another object to provide such a stand with short stroke cylinders and auxiliary spacing or filling-out means. It is yet another object to provide such a stand in which the spacing means for the lower rolls are incorporated into the conventional roll-changing sled. It is a further object to provide such a mill stand with auxiliary hydraulic means to facilitate setting the rolls to the pass line. Other objects of our invention will appear in the course of the description thereof which follows.

The mill stand of our invention, described briefly, comprises a pair of conventional housings each provided with a short stroke pressure cylinder at the top beneath the cross head. Means are provided to swing a series of graduated filler blocks, positioned around a quadrant so as to form a circular staircase, in between the cylinder piston and the upper back-up roll chock. Separate cylinder means are provided to raise and lower the upper back-up roll and work roll when pressure is released therefrom. The lower back-up roll chocks rests on staircases movable transversely of the stand and conveniently carried by the conventional roll changing sled. The staircase steps are of uniform height. Between the bottom of the housings and the sled is a low-angle wedge adapted to raise the lower roll assembly the height of one step of the staircase. Separate cylinder means are provided to raise and lower the lower back-up roll and work roll when pressure is released therefrom.

Figure 2:
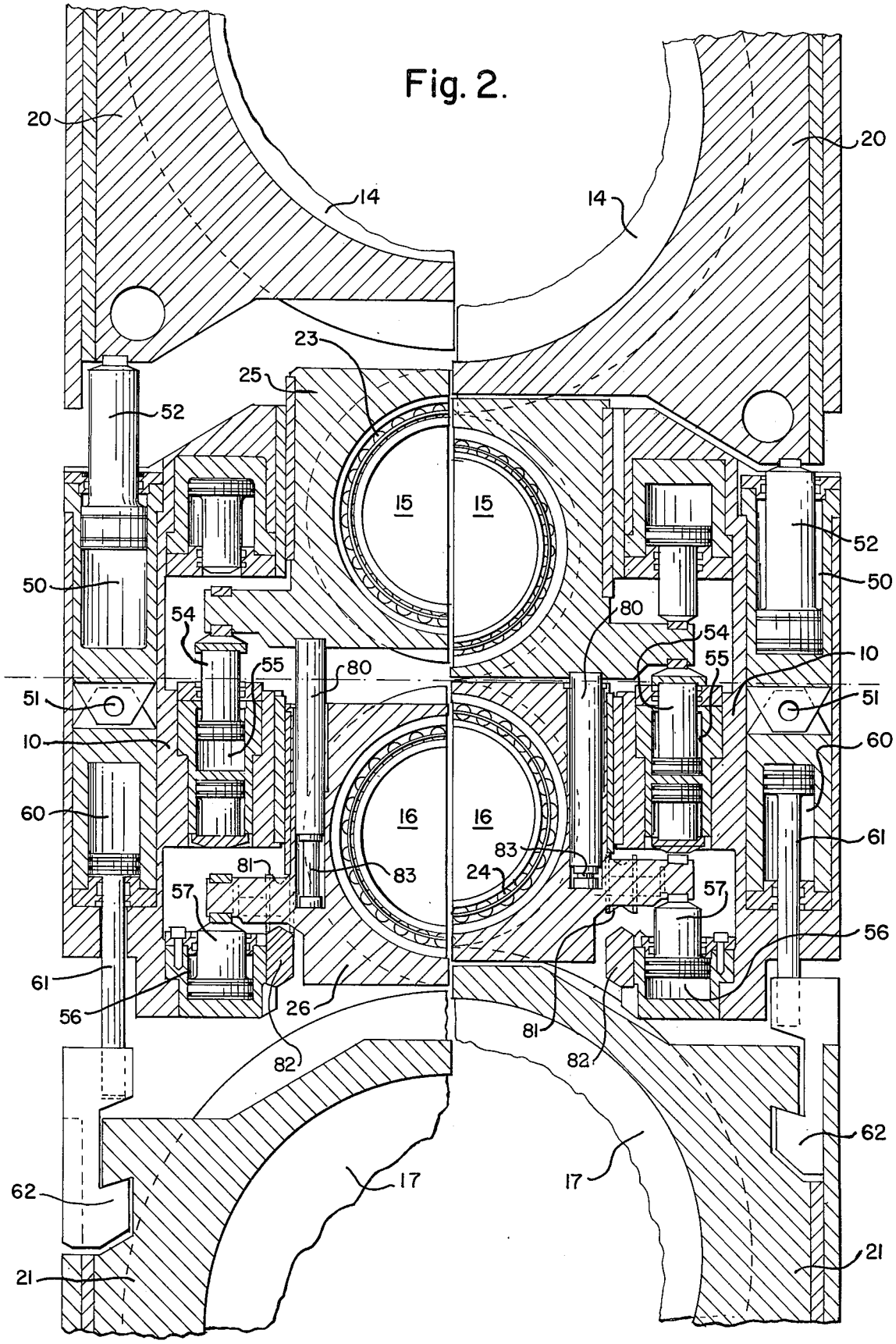

An embodiment of our invention presently preferred by us is illustrated in the attached figures, to which reference is now made:

FIG. 1 is a side elevation of the operator's side of a mill stand of our invention, FIG. 2 is an enlarged detail in cross section of the central portion of the stand of FIG. 1 split along the vertical center line to show the position of the rolls and their supporting means for maximum and minimum roll diameters.

Figure 3:
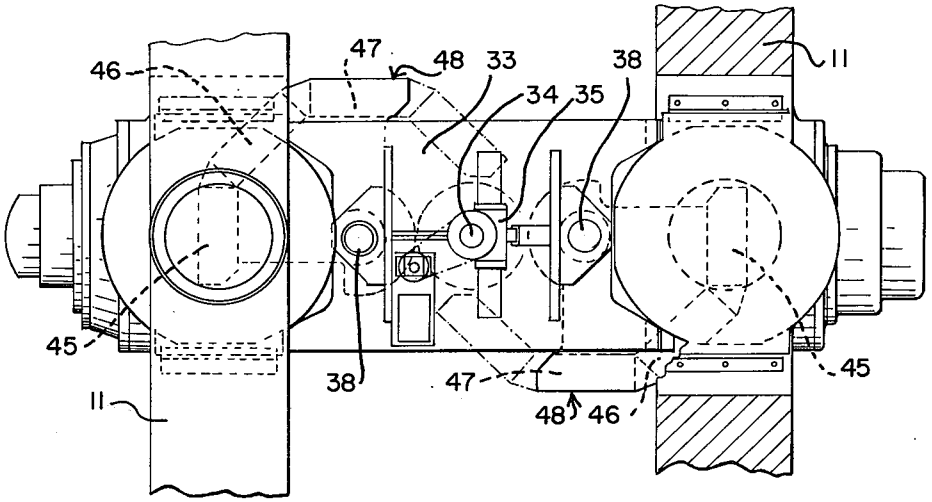
Figure 8:
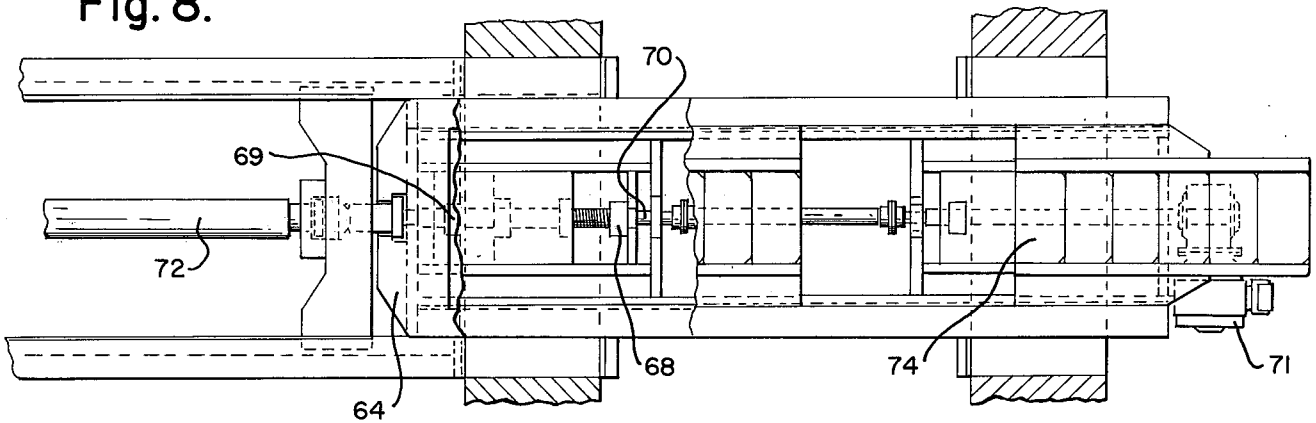
Figure 5:
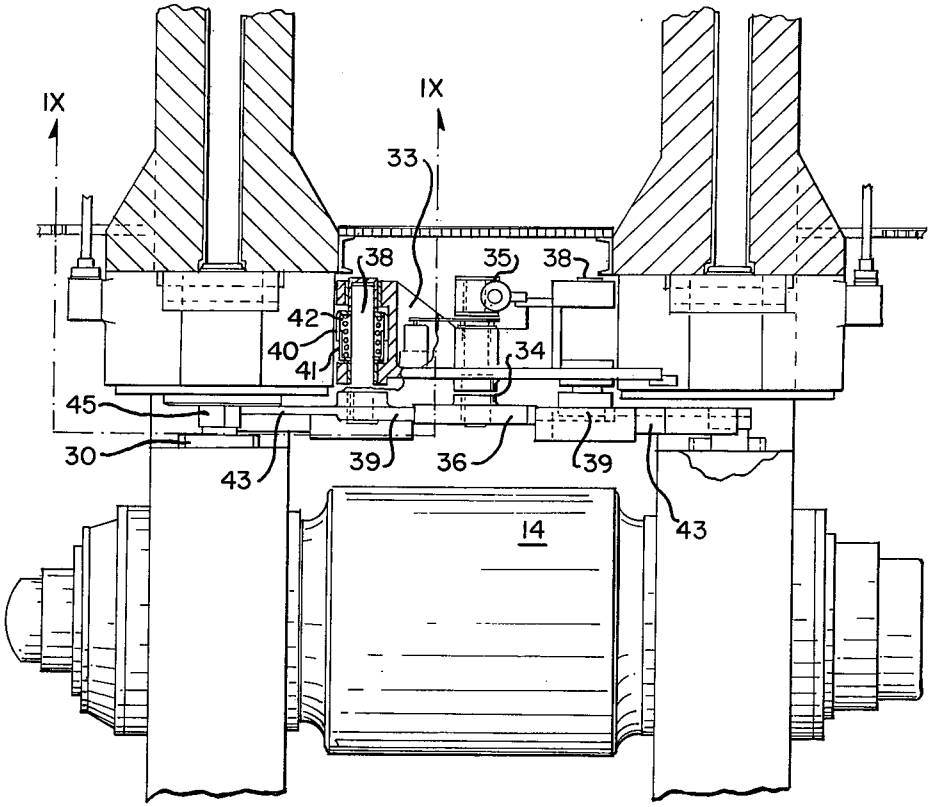
Figure 4:
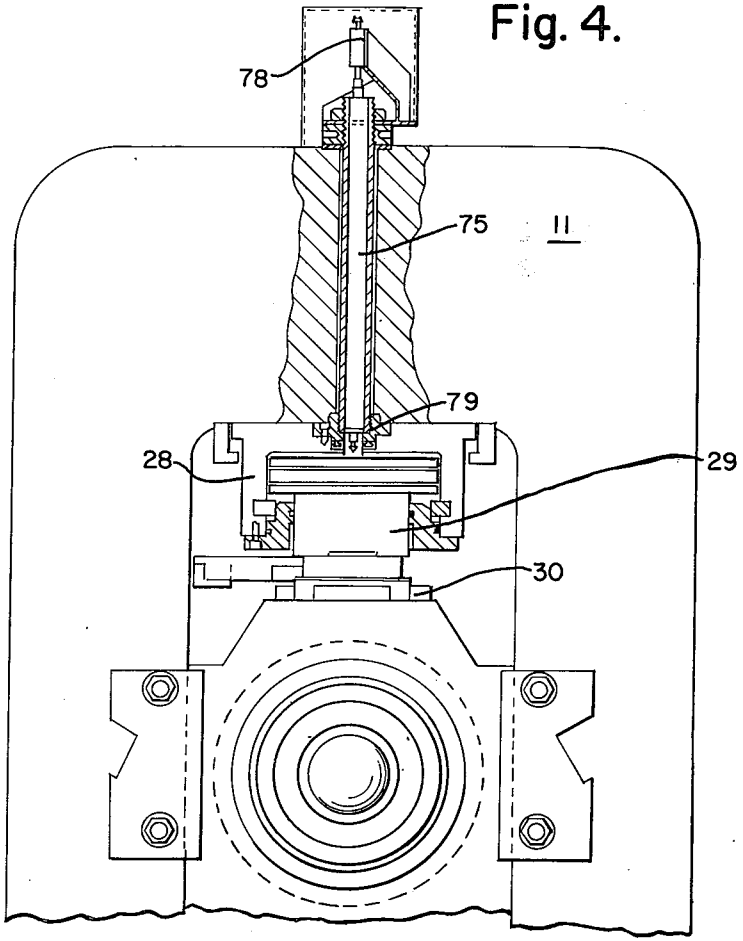
Figure 6:
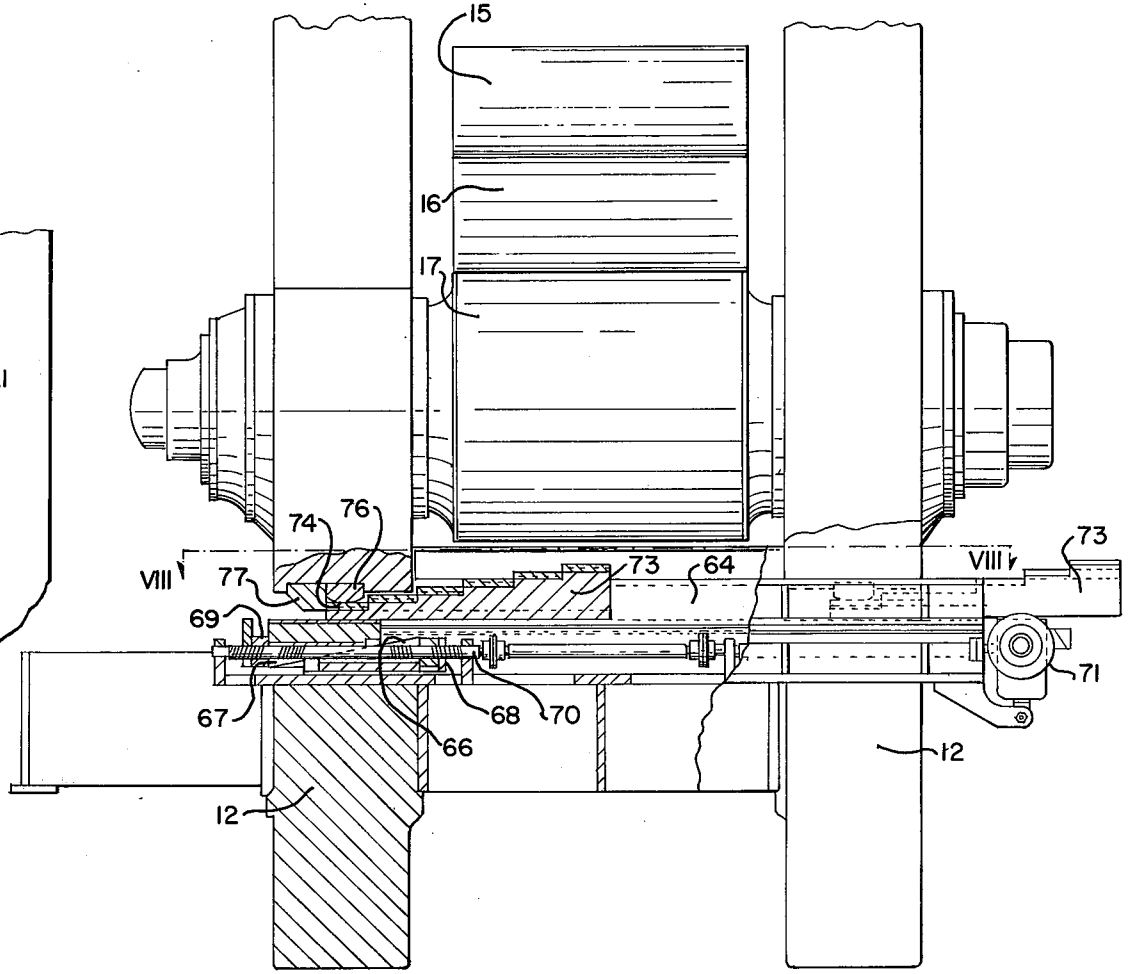
Figure 7:
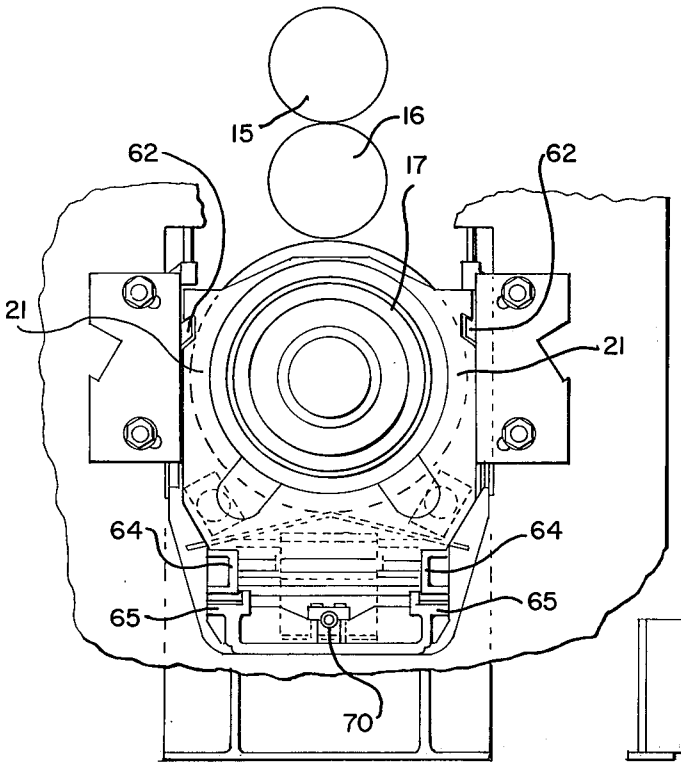

FIG. 3 is a plan of the central portion of the stand, partly broken away and partly in section, FIG. 4 is a partial operator's side elevation, partly in cross section, of the upper portion of the stand corresponding to FIG. 3, FIG. 5 is an end elevation, partly in cross section, of the upper portion of the mill stand corresponding to FIGS. 3 and 4, FIG. 6 is an end elevation, partly in cross section, of the lower portion of the stand of FIG. 1, FIG. 7 is an operator's side elevation of the portion of the stand shown in FIG. 6, FIG. 8 is a horizontal section, partly broken away, taken on the plane VIII—VIII of FIG. 6.

FIG. 9 is an underside detail, of a portion of FIG. 5 taken on the plane IX—IX of that figure, FIG. 10 is a cross section of FIG. 9 taken on the plane X—X of that figure, and FIG. 11 is an exploded view in perspective of the roll changing sled, staircase and wedge components.

The mill stand, shown in FIG. 1, is contained in a pair of closed top and closed bottom housings 10 having the usual window, a solid top or cross head 11 and a solid base 12. Within the housing 10, so as to be removable through its window, are from top to bottom, an upper back-up roll 14, an upper work roll 15, a lower work roll 16 and a lower back-up roll 17. The upper back-up roll 14 is mounted in chocks 20 and the lower back-up roll 17 is mounted in chocks 21. The upper work roll 15 is mounted in roll-neck roller bearings 23 which are held in supporting means 25. The lower work roll 16 is mounted in roll-neck roller bearings 24 which are held in supporting means 26. The chocks 20 and 21 and the bearing supporting means 25 and 26 are movable vertically in the window of housing 10. Work rolls 15 and 16 are driven in the usual manner.

Under the cross head 11 of each housing 10 is provided an upright hydraulic pressure cylinder 28 of relatively large diameter and relatively short stroke. The piston 29 extends downwardly from cylinder 28. Between piston 29 and a rocker plate 30 on the top of upper back-up roll chock 20 is inserted a selected filler block by apparatus to be described, shown in FIGS. 3 and 5 and in detail in FIGS. 9 and 10.

In horizontal member 33 bridging cross heads 11 of the housings 10 of the stand is journalled a vertical shaft 34 midway between the two housings 11. To the upper end of shaft 34 is fitted a hydraulic rotating mechanism 35 capable of rotating shaft 34 through 180°. On the lower end of shaft 34 is affixed broad-faced gear 36. Intermediate shaft 34 and each cross head 11 is journalled in horizontal member 33 a vertical shaft 38 carrying on its lower end a sector gear 39 which meshes with gear 36, one on each side thereof. The faces of sector gears 39 are narrower than the face of gear 36. Within its housing in member 33 each shaft 38 carries near its upper end an inverted cup 40 affixed thereto, the wall of the cup 40 being spaced from the shaft 38. An upright cup 41 affixed to member 33 fits up inside inverted cup 40 in sliding relation therewith. Within the overlapping cups 40 and 41 and coiled around shaft 38 is a coil compression spring 42 which urges the cups 40 and 41 away from each other within their housing member 33. The lower end of each shaft 38 projects below housing 33 and carries, in addition to sector gear 39, a quadrant of an inscribed octagon 43 having a radius somewhat greater than the spacing between shaft 38 and the center of hydraulic cylinder piston 29, and a planar upper surface. Around the periphery of quadrant 43 on its lower surface are affixed three rectangular filler blocks or steps 45, 46 and 47, end to end, so as to occupy that periphery. The length of each block 45, 46 and 47 is somewhat less than the diameter of piston 29 of hydraulic cylinder 28. The thickness, or vertical dimension of the three blocks increases successively by the same amount, as is shown in FIG. 10, so that the blocks form, as it were, an inverted circular staircase 48 (FIGS. 9 & 10). Initial rotation of quadrant 43 from a position clear of piston 20 brings the lowest block 45 in position between piston 20 and rocker plate 30 previously described; continued rotation of plate 43 in the same direction brings successively higher block or step 46 and highest step 47 into position. With coil spring 42 extended, quadrant 43 is raised so that it rotates just below piston 20 in the fully retracted position of that piston.

When hydraulic cylinder 28 is not exerting rolling pressure on the upper back-up roll chocks 20, those chocks and upper back-up roll 14 are supported by hydraulic positioning cylinders 50, one on each side of the window of housing 10, as shown in FIG. 2. Cylinders 50 rest on housing 10 at their lower ends and are attached thereto by pins 51. The piston rod 52 of each cylinder engages the lower surface of chock 20. When rolling pressure is removed from upper work roll 15, its supporting means 25 rest on the piston rods 54 of upright positioning hydraulic cylinders 55, one on each side of the housing window. Cylinders 55 are affixed to housing 10. Also affixed to housing 10 are upright hydraulic positioning cylinders 56, one on each side of housing 10, positioned to support lower work roll supporting means 26 by piston rods 57 when rolling pressure is removed from lower work roll 16. When rolling pressure is removed from lower back-up roll 17, its chocks 21 may be supported by inverted hydraulic positioning cylinders 60, one on each side of the window of housing 10, resting thereon and attached to that housing by pins 51. Their piston rods 61 carry hook means 62 which engage mating recesses in chocks 21. The remaining hydraulic cylinders shown in the figures are used for purposes not connected with this invention and so are not described.

At the bottom of housing 10 on its base 12 is positioned a sled 64 which moves through the window in housing 10 on ways 65 and can be the conventional roll-changing sled used to remove the lower back-up roll 17 in its chocks 21. These elements are best shown in FIGS. 6, 7 and 8. Between base 12 and sled 64, at each end, below a chock 21, is a split wedge of low angle, such as 5°, comprising a lower element 66 and upper element 67, as shown in FIG. 11. Centrally affixed at the thick end of lower element 66 inside housing 10 is a right-hand thread nut 68 and affixed to the thick end of upper element 67 aligned with nut 68 is a left-hand thread nut 69. Nuts 68 and 69 are affixed to their respective wedge elements so as to allow vertical movement between wedge element and nut. A shaft 70 extends horizontally through nuts 68 and 69 and terminates in a right angle drive gear motor 71. Shaft 70 is threaded with a right-hand thread where it passes through nut 68 and with a left-hand thread where it passes through nut 69, so that rotation of shaft 70 in one direction causes wedge elements 66 and 67 to move toward each other, so increasing their combined thickness. Rotation of shaft 70 in the opposite direction causes the wedge elements to move away from each other, so decreasing their combined thickness. Sled 64 is moved by a hydraulic cylinder, not shown, and piston rod 72.

Sled 64 carries a pair of straight staircases 73 each disposed transversely of stand 10 and spaced from each other so as to occupy corresponding positions between sled 64 and lower back-up roll chocks 21. Each staircase 73 comprises a lowermost step 74 and five additional steps, each higher than the preceeding step by the same amount, and each of the same width as step 74. The lower face of chock 21 is fitted with a rocker plate 76 dimensioned to rest on step 74 or other step of staircase 73. Projecting from the lowermost face of chock 21 below the bottom of rocker plate 76 is a stop member 77. Stop member 77 is located at one side of rocker plate 76 opposite staircase 73 so as to abut the outside vertical face of first step 74 when chock 21 is supported in its lowermost unloaded position by hydraulic cylinders 60 previously described. Stop 77 does not project below rocker plate 76 the full height of step 74 or succeeding steps. Succeeding steps of staircase 73 are moved between rocker plate 76 and sled 64 by movement of the latter when chocks 21 are lifted to higher positions by hydraulic cylinders 60, movement of sled 64 being automatically stopped when stop member 77 engages the edge of a step.

In order that the mill operator may be able to gauge the roll position in the housing upper cross head 11 of stand 10 is formed with a centrally located vertical hole which also extends through the upper end of hydraulic cylinder 28, as shown in FIG. 4. In this hole a rod 75 is positioned to move freely, its lower end projecting through suitable packing 79 into hydraulic cylinder 28 and being attached to the piston 29. The upper end of rod 75 is attached to a linear transducer 78 which, with conventional auxiliary apparatus not shown, converts the linear position of rod 75 to a reading on a remote scale conveniently located for observation by the operator.

To facilitate roll changing a pair of rails 82 is positioned below lower work roll supporting means 26 extending crossways of the mill stad and through the window in housing 10 (FIG. 2). Work roll supporting means 26 are provided with wheels 81 which roll on rails 82 when the work roll is being removed. Likewise, to facilitate roll changing and alignment of the mill after roll changing lower work roll supporting means 26 are provided with a pair of auxiliary upright hydraulic cylinders 80 with piston rods 83. The latter rest on work roll supporting means 26, while the cylinders 80 bear against the underside of upper work roll supporting means 25. Cylinders 80 and adjusted to provide in their extended position a predetermined separation between new or unworn work rolls 15 and 16 when pistons 54 of cylinders 55 are withdrawn from contact with the upper work roll supporting means 25.

The mill structure described hereinabove and illustrated in the attached figures makes possible improved pass alignment, pressure leveling, and zeroing of the mill after a roll change, which will not be described.

Both work rolls and back-up rolls are removed from the stand and replaced therein transversely through the window in the housing on theoperator's side, as in conventional. Before removing or replacing those rolls, piston 29 is retracted fully into hydraulic cylinder 28. Hydraulic rotating mechanism 35 is operated to rotate shaft 34 with gear 36 affixed thereto, which in turn rotates sector gear 39 and quadrant 43 so as to rotate staircase 48 clear of piston 29. The retraction of piston 29 through its short stroke, which may be on the order of two inches, and the withdrawal of staircase 48 are accomplished rapidly, much faster than a mechanical screw down can be raised and equal distance. The gap so left between piston 29 and chocks 20 permits upward movement of those chocks and upper back-up roll 14. Chocks 20 and upper back-up roll 14 are lifted by hydraulic cylinders 50 previously described. Upper work roll 15 and its supporting means 25 are lifted by auxiliary hydraulic cylinder 80 which, as have been mentioned, come to a fixed stop which separates the work rolls by predetermined distance when pistons 54 of cylinders 55 are withdrawn. At the same time the bottom set of rolls 16 and 17 are lowered by clinders 60 so as to allow the bottom work roll supporting means wheels 81 to rest on rails 82 for roll extraction. The two work rolls 15 and 16 are changed in pairs by conventional rapid roll changing means. The two back-up rolls 14 and 17 are changed conventionally on the bottom sled 64 after the work rolls have first been removed and the back- up roll chocks separated by a suitable stool, not shown. After new work rolls, which may have diameters differing from those of the set removed, have been inserted in the mill a new pass line adjustment and roll alignment becomes necessary.

When the new or reground rolls are returned to the stand, the transducer 78 is set at preliminary zero with piston 29 fully retracted. Hydraulic rotator 35 is then actuated, which rotates quadrant 43, and by that rotation the step of staircase 48 appropriate for the new work roll diameter is inserted between piston 29 and chock 30. By means of hydraulic cylinders 50 and 55, the top roll set (work roll 15 and back-up roll 14) is lowered until the lower surface of work roll 15 is tangent to the pass line of the strip.

After the top set of rolls is set on the pass line, the bottom back-up roll 17 is raised by actuating cylinders 60. It carries with it bottom work roll 16 until the latter makes contact with the lower surface of top work roll 15. Pistons 57 of cylinders 56, which are under presure, will also rise to support the bottom work roll supporting means 26. Auxiliary cylinders 80, which are also under pressure, will maintain contact with the upper work roll supporting means 26. In the suspended condition of the lower roll set rocker plate 76 (FIG. 6) is clear of step 74 so that sled 64 carrying staircases 73 can be moved transversely of the roll stand as far as it will go before a step makes contact with stop 77. This movement is accomplished by the existing back-up roll changing cylinder 72 which is under relatively low pressure. The raising of the sled 64 so that one of its steps will contact the rocker plate is achieved by the low angle wedge mechanism 66 and 67.

It is obvious from the above description that the setting of the pass line after a roll change is achieved by utilizing the control system of hydraulic cylinders 28 to bring the bottom surface of the top work roll 15 exactly to the pass line. The bottom roll set, i.e., work roll 16 and back up roll 17, is then raised as far as possible until the work rolls touch as has been described. This process eliminates an additional system which would be necessary if the bottom set of rolls were first raised, as is sometimes done with known mill stands.

The rolls are then caused to rotate by the drive motors, the preselected pressure is applied to hydraulic cylinders 28 and the zero of transducer 78 is readjusted. Cylinders 50 and 55, which lift upper back-up roll 14 and upper work roll 15 respectively are energized and under pressure during the operation of the mill, producing lift forces a few percent higher than the weight of the rolls and chocks to be balanced. Piston 29 of hydraulic cylinder 28, therefore, adjusts the rolls against this balancing pressure, which is kept constant by conventional means. The shafts 38 carrying the staircase quadrants 43 are spring loaded so as to urge the staircases 48 against the pistons 29 of pressure cylinders 28, as has been mentioned. Staircases 48, therefore, move downward with downward movement of pistons 29 caused by the application of rolling pressure to the rolls in the housing. The movement of piston 29 is reversed, the desired gap between work rolls 15 and 16 is set by the hydraulic positioning cylinders 55, and the stand is ready to operate.

In the foregoing description, the term "pressure cylinder" means a cylinder capable of applying rolling pressure. The term "positioning cylinder" means a cylinder capable of lifting only the weight of the apparatus supported by it, in the absence of rolling pressure.

In the foregoing specification I have described presently preferred embodiments of my invention; however, it will be understood that my invention can be otherwise embodied within the scope of the following claims.

We claim:

1. In a mill stand for a four-high strip mill including a pair of closed top and bottom housings, upper and lower work rolls disposed within the housings above and below the pass line of the strip, upper and lower back up rolls disposed within the housing above and below the upper and lower work rolls respectively, chocks for the upper back up rolls movable vertically in the housings and chocks for the lower back up roll movable vertically in the housings, the improvement comprising a pair of hydraulic pressure cylinders, each positioned centrally within a housing at the top thereof and adapted with the bottom of the housing to exert rolling pressure through the upper and lower back up roll chocks on the rolls within the housing, a pair of staircases, one in each housing, each comprising a single series of steps of uniformly increasing height, each staircase being a circular staircase disposed about a vertical axis parallel to the axis of the hydraulic pressure cylinder and spaced therefrom, and means for introducing those staircases, step-by-step in pressure-transmitting sequence with the hydraulic pressure cylinders, upper and lower roll chocks and bottom of the housing, those means comprising a member carrying the staircase rotatable about the axis of the staircase so as to carry successive steps of the staircase singly through the axis of the hydraulic pressure cylinder and means for rotating that member, whereby when the travel of the chocks in the housing exceeds the stroke of the cylinders, that stroke is extended in increments by the introduction of the successive steps of the staircase.

2. Apparatus of claim 1 in which the staircases are introduced between the pistons of the hydraulic pressure cylinders and the chocks of the upper back-up roll.

3. Apparatus of claim 1 including spring loaded means urging the carrier member vertically upwards so that the staircase follows movement of the piston of the hydraulic pressure cylinder.

4. Apparatus of claim 1 in which the staircases and means for introducing those staircases comprise a member bridging the housings above the rolls, a vertical shaft journaled centrally therein, a pair of vertical shafts journalled in the bridging member each intermediate the central shaft and one of the hydraulic pressure cylinders and each having a staircase-carrying member affixed at one end thereof and a sector gear at the other end thereof, a gear affixed at one end of the central shaft meshing with each of the sector gears and means connected with the other end of the central shaft for rotating it.

5. The method of aligning around the strip pass line the rolls of a four-high mill stand provided with a pair of hydraulic rolling pressure cylinders and with fluid operated positioning cylinders for both upper and lower roll sets comprising positioning the upper roll set with the upper work roll above the pass line and so as to leave a gap between the pressure cylinders and upper back-up roll chocks, inserting in that gap a filler block, moving the upper roll set down by means of the hydraulic rolling pressure cylinders and against the lifting force of the positioning cylinders until the upper work roll is tangent to the pass line, positioning the lower roll set with the lower work roll touching the upper work roll so as to leave a gap between the bottom of the roll stand and the lower back-up roll chocks, inserting in that gap a filler block and a wedge sufficient to fill the gap, and applying pressure to the rolls by means of the hydraulic rolling pressure cylinders.

6. In a mill stand for a four-high strip mill including a pair of closed top and bottom housings, upper and lower rolls disposed within the housings above and below the pass line of the strip, upper and lower back up rolls disposed within the housing above and below the upper and lower work rolls respectively, chocks for the upper back up rolls movable vertically in the housings and chocks for the lower back up roll movable vertically in the housings, the improvement comprising a pair of hydraulic pressure cylinders, each positioned centrally within a housing at the top thereof and adapted with the housing to exert rolling pressure through the upper and lower back up roll chocks on the rolls within the housing, a pair of staircases comprising a series of steps of uniformly increasing height, each staircase being a straight staircase disposed transversely of the roll stand, and means for introducing those staircases step-by-step in pressure-transmitting sequence with the hydraulic pressure cylinders, upper and lower roll chocks and the housing, and including in that pressure-transmitting sequence a pair of split wedges, the halves of which slide upon each other a distance sufficient to raise or lower the staircases by an amount at least equal to the height of a step thereof, whereby the pass line of the rolls can be adjusted.

7. Apparatus of claim 6 in which the hydraulic pressure cylinders are positioned at the top of the housing and the staircases and split wedges are introduced between the bottom of the housings and the chocks of the lower back up roll, whereby the bottom work roll can be adjusted to the pass line of the strip.

8. Apparatus of claim 7 including positioning means affixed to the housing and engaging the lower back-up roll adapted to raise and lower that roll in the absence of rolling pressure thereon, whereby the lower work roll and back-up roll can be lifted to permit adjustment of the staircases and split wedges.

9. Apparatus of claim 8 in which the positioning means are affixed to he housing above the chocksof the lower back-up roll.

* * * * *